US006501058B2

(12) United States Patent
Jung

(10) Patent No.: US 6,501,058 B2
(45) Date of Patent: Dec. 31, 2002

(54) METHOD FOR CONTROLLING DEFROSTING IN MICROWAVEN OVEN

(75) Inventor: Yu Jin Jung, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/967,988

(22) Filed: Oct. 2, 2001

(65) Prior Publication Data

US 2002/0063127 A1 May 30, 2002

(30) Foreign Application Priority Data

Nov. 30, 2000 (KR) ..... 00-71985

(51) Int. Cl.[7] ..... H05B 6/68

(52) U.S. Cl. ..... 219/703; 219/710; 426/241; 426/524; 99/325

(58) Field of Search ..... 219/703, 702, 219/710, 711; 426/241, 243, 524; 99/325, DIG. 14

(56) References Cited

U.S. PATENT DOCUMENTS 4,171,382 A * 10/1979 Buck ..... 426/243
4,705,926 A * 11/1987 Sakai et al. ..... 219/703
6,013,907 A * 1/2000 Lee ..... 219/703
6,198,084 B1 * 3/2001 Kim ..... 219/703
6,299,920 B1 * 10/2001 Saksena ..... 219/711

FOREIGN PATENT DOCUMENTS

EP 0 746 181 * 12/1996

* cited by examiner

*Primary Examiner*—Philip H. Leung
(74) *Attorney, Agent, or Firm*—Fleshner & Kim, LLP

(57) ABSTRACT

Method for controlling defrosting in a microwave oven having an infrared sensor, including the steps of (a) controlling a first defrosting up to a preset temperature upon reception of defrosting key application from a user, (b) turning over frozen food upon completion of the first defrosting, and (c) periodically detecting a surface temperature of the turned over frozen food by using the infrared sensor, and controlling a second defrosting according to the detected surface temperature and temperature variation, whereby permitting an optimal defrosting of the frozen food by making voltage application condition control according to the periodic detection of a surface temperature of frozen food by an infrared sensor, not only in the first defrosting when one side of the frozen food is heated, but also in the second defrosting after the turn over of the frozen food, and to prevent a pre-mature, or excessive defrosting by making defrosting control based on the surface temperature and the temperature variation of the frozen food.

26 Claims, 5 Drawing Sheets

METHOD FOR CONTROLLING DEFROSTING IN MICROWAVEN OVEN

BACKGROUND OF THE INVENTION

1. Field of the Invention

The present invention relates to a microwave oven, and more particularly, to a method for controlling defrosting in a microwave oven, in which an actual temperature of a surface of food is detected continuously during defrosting of the food, for controlling a defrosting process.

2. Background of the Related Art

The microwave oven heats food in a cavity by means of an ultra high frequency wave (2450 MHz) from a magnetron. In order to make an accurate food heating control in the microwave oven, an infrared sensor is fitted on one side of the cavity, for projection to the food, to detect a surface temperature of the surface of the food, and transmission of the information to a microprocessor in the microwave oven, so that the microprocessor can determine heating and control conditions thereafter based on the detected surface temperature of the food.

Referring to FIG. 1, a related art microwave oven is provided with a turntable 11 for placing food to be cooked thereon, a magnetron 12 for generating, and supplying a microwave to the food in the cavity 10 through a waveguide, a cooling fan 13 for cooling the heated magnetron 12, an infrared sensor 14 for detecting a temperature of the food, and a control part (not shown) for controlling operation of the magnetron 12.

The operation of the foregoing microwave oven will be explained. When the user provides a cooking command to the microwave oven, the control part puts the magnetron 12 into operation. A microwave generated at the magnetron 12 is directed to the cavity 10 through the waveguide, and heats the food. The infrared sensor 14 detects a surface temperature of the food, and provides a voltage for a surface temperature of the food, which signal is passed through a series of signal processing, and provided to the control part. According to this, the control part operates the magnetron 12 to heat the food until a cooking temperature reaches to a target temperature, and the cooling fan 13 during cooking for cooling the heated magnetron 12. Positions of the infrared sensor 14 and the cooling fan 13 are not limited to the positions shown in FIG. 1, but may differ depending on types of the microwave oven; different from the positions shown in FIG. 1, the positions may be varied, such that the infrared sensor is fitted to a right side of the cavity, and the cooling fan is fitted to a top of the cavity.

A defrosting process of frozen food may differ from general food heating. A related art defrosting process of frozen food in the microwave oven will be explained, with reference to FIG. 2. FIG. 2 illustrates a graph showing time vs. a temperature variation of frozen food, wherein hatched blocks denote power turned on time periods during which a power is supplied into the cavity 10 as a heating energy. That is, the magnetron is operative in periods shown in hatched blocks to direct the microwave to the frozen food inside of the cavity 10. In a case the frozen food is to be defrosted, the microwave oven is put into operation in a state a surface temperature thereof is below zero, when the infrared sensor 14 at one side of the cavity 10 detects a variation of the surface temperature of the frozen food. In the meantime, as the surface temperature of the frozen food is at a low temperature, even though the power turned on time period is long in an initial defrosting, the power turned on time period becomes shorter, gradually. That is, because a temperature of the frozen food rises gradually as the defrosting proceeds, the power turned on time periods become the shorter as a frozen food turn over time period 'P' approaches. At the turn over time 'P', the user opens a door on the microwave oven, turns the frozen food over, and proceeds the defrosting, again. When the defrosting is started again in a state the frozen food is turned over, a power turned on time period of the magnetron is controlled at fixed intervals baser on a time period taken from the initial defrosting to the turn over 'P', and a power condition until the turn over time period 'P' is reached. That is, after the frozen food is turned over, the defrosting is carried out in a certain time period and power, taking a time period taken in a first defrosting of the frozen food (a defrosting process until the turn over) and a power condition in the time period into account. Therefore, in the second defrosting process after the frozen food is turned over, a process proceeds, in which merely the magnetron 12 is turned on/off periodically based on the time period taken in the first defrosting and the power condition in the time period.

Consequently, the related art defrosting in the microwave oven has a problem in that defrosting of frozen food is not made properly in a case frozen states differ on both sides of the frozen food to be defrosted due to shape or other. In the related art defrosting, the defrosting after the frozen food is turned over is carried out regardless of the surface temperature of the turned over frozen food, that causes problems of a product reliability deterioration coming from pre-mature defrosting, or excessive defrosting, or inconvenience to the user.

SUMMARY OF THE INVENTION

Accordingly, the present invention is directed to a method for controlling defrosting in a microwave oven that substantially obviates one or more of the problems due to limitations and disadvantages of the related art.

An object of the present invention is to provide a method for controlling defrosting in a microwave oven, which can control a second defrosting according to an actual temperature of frozen food.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for controlling defrosting in a microwave oven having an infrared sensor, includes the steps of (a) controlling a first defrosting up to a preset temperature upon reception of defrosting key application from a user, (b) turning over frozen food upon completion of the first defrosting, and (c) periodically detecting a surface temperature of the turned over frozen food by using the infrared sensor, and controlling a second defrosting according to the detected surface temperature and temperature variation.

An initial voltage application time period in the step (a) or (c) is made relatively longer than the voltage application time period in a later half of each of the steps.

The step (a) includes the steps of calculating a turning over time point by using the presently progressive minimum temperature Min_T and a minimum temperature variation ΔT, calculating a first defrosting voltage by using a greater value ΔTmax of the minimum temperature variation ΔT and a maximum temperature variation ΔTm, and the presently progressive minimum temperature Min_T, and carrying out defrosting according to the calculation, and generating a signal sound if the minimum temperature Min_T or a maximum temperature Max_T is higher than a preset temperature, or if the turning over time point is over a preset time point.

The step (c) includes the steps of calculating a defrosting finish time point and a second defrosting time period upon reception of a starting key again after the frozen food is turned over, calculating a second defrosting voltage by using a smaller temperature variation value ΔTmin, and the presently progressive minimum temperature Min_T upon calculation of the defrosting finish time point and the second defrosting time period, the smaller temperature variation value ΔTmin being selected from the minimum temperature variation ΔT and a maximum temperature variation ΔTm obtained based on the surface temperature detection of the frozen food, and finishing defrosting if the minimum temperature Min_T or the maximum temperature Max_T is higher than a preset temperature, the present time point is the same with the calculated finish time point, or the calculated defrosting time period is passed.

The voltage application condition control according to the periodic detection of a surface temperature of frozen food by an infrared sensor, not only in the first defrosting when one side of the frozen food is heated, but also in the second defrosting after the turn over of the frozen food permits an optimal defrosting of the frozen food. That is, the defrosting control based on the surface temperature and the temperature variation of the frozen food permits to prevent a pre-mature, or excessive defrosting, and the optimal defrosting made available by the present invention provides a satisfaction and reliability on the product to the user.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
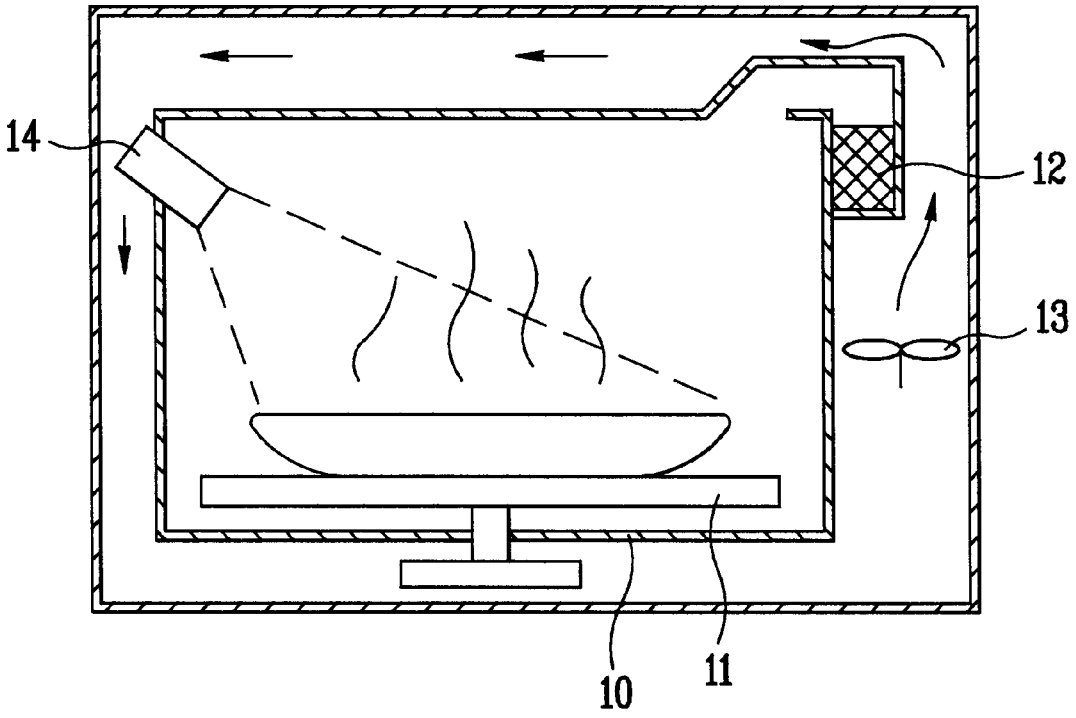
FIG.1 Prior Art
FIG. 1 illustrates a related art microwave oven.
Figure 2:
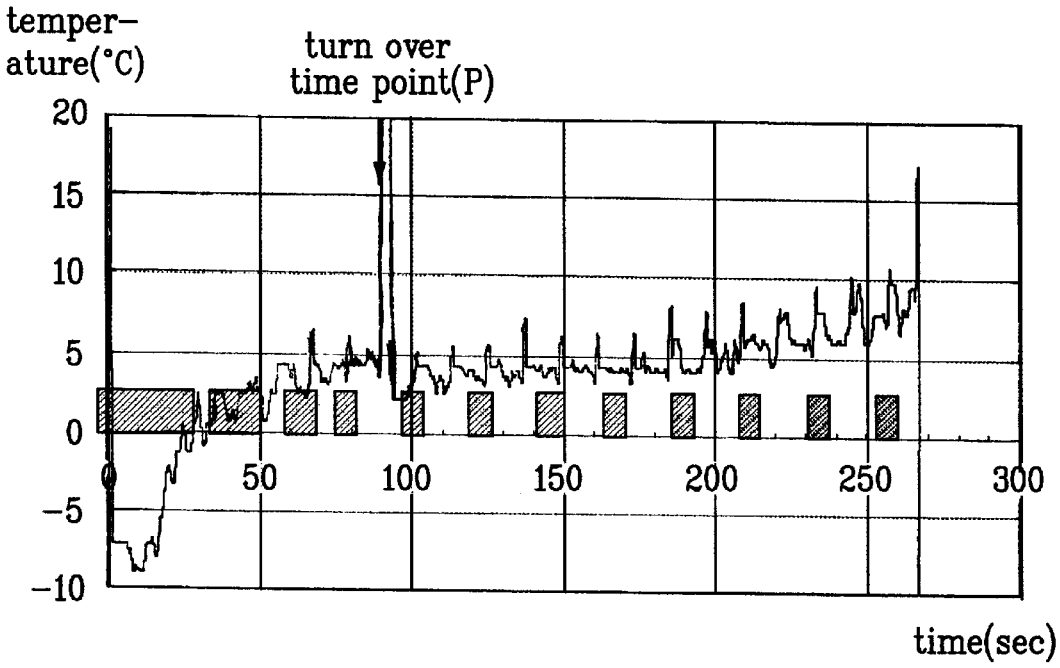
FIG.2 Prior Art
FIG. 2 illustrates a graph showing a related art time vs. a temperature variation of frozen food.
Figure 3A:
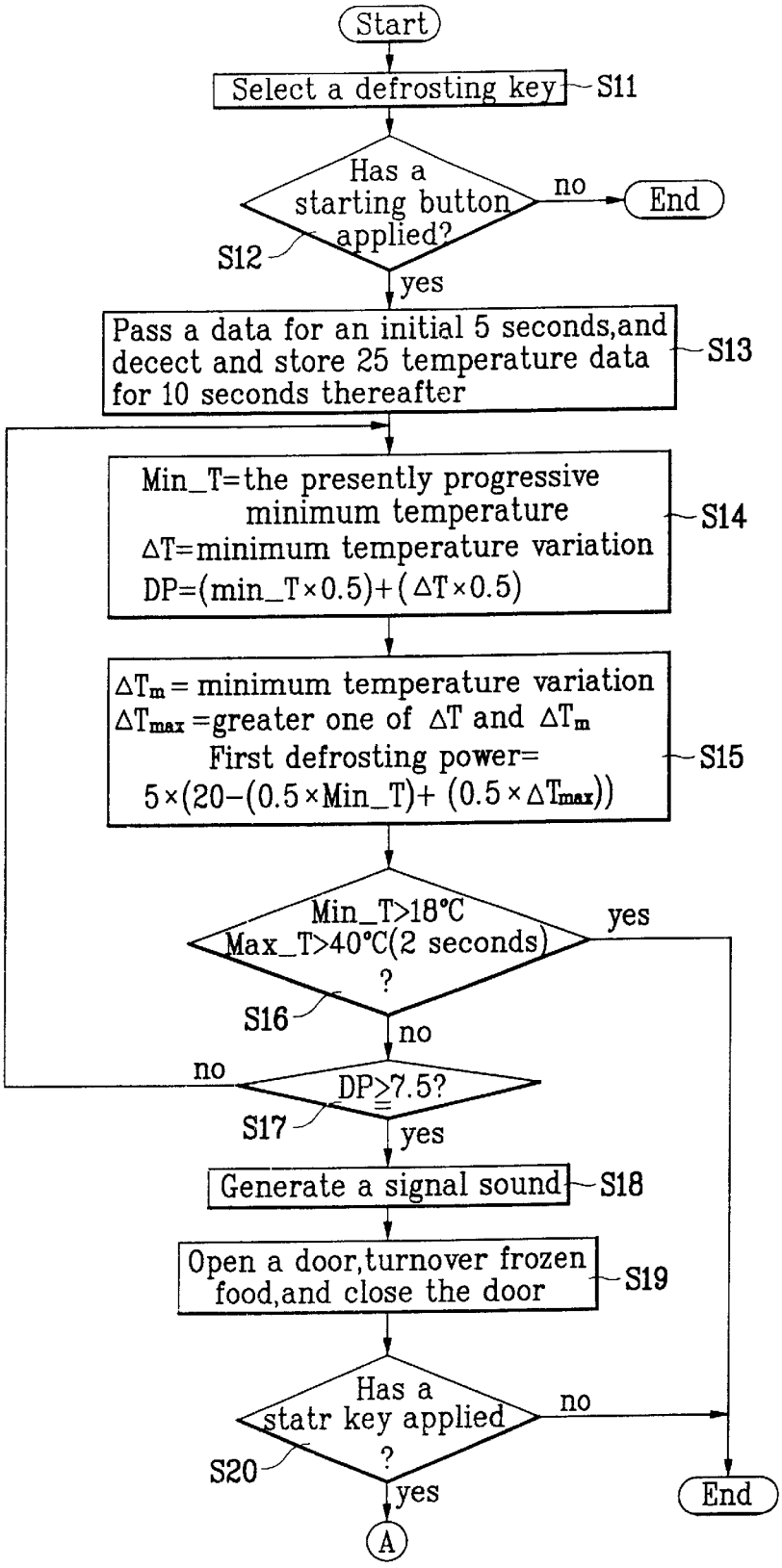
FIGS. 3A and 3B illustrate a flow chart showing a method for controlling defrosting in a microwave oven in accordance with a preferred embodiment of the present invention; and, FIG. 4 illustrates a graph showing time vs. a temperature variation of frozen food in accordance with a preferred embodiment of the present invention.
Figure 3B:
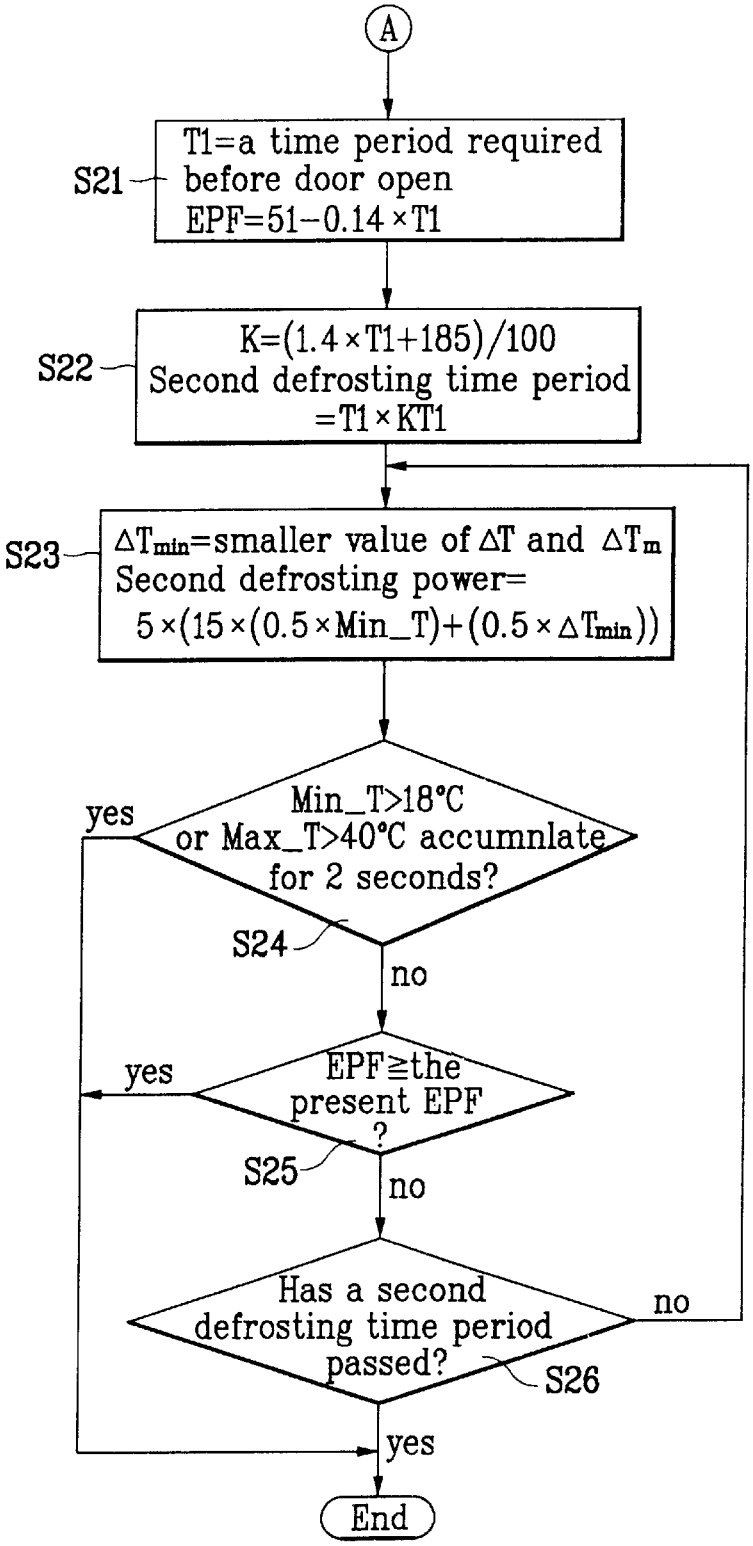
Figure 4:
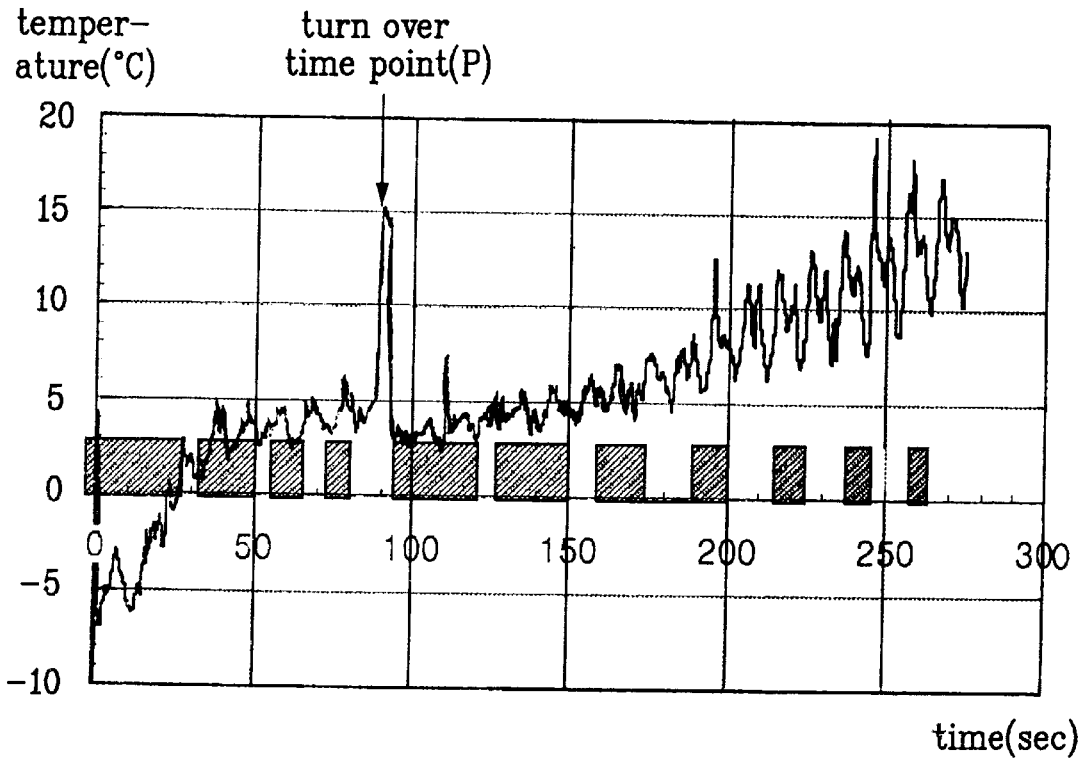

Reference will now be made in detail to the preferred embodiments of the present invention, examples of which are illustrated in the accompanying drawings. FIGS. 3A and 3B illustrate a flow chart showing a method for controlling defrosting in a microwave oven in accordance with a preferred embodiment of the present invention, and FIG. 4 illustrates a graph showing time vs. a temperature variation of frozen food in accordance with a preferred embodiment of the present invention.

Referring to FIGS. 3A and 3B, in the method for controlling defrosting in a microwave oven in accordance with a preferred embodiment of the present invention, selection of a defrosting key by the user is determined S11. User's pressing of a start button is determined S12. As a result of the determination S12, if the user presses the start button, a data for an initial 5 seconds, is not stored, but lets pass, and 25 temperature data detected from 6th second to 10th second thereafter is stored S13. Then, the presently progressive minimum temperature Min_T and minimum temperature variation ΔT are detected and applied to the following equation (1), for calculating a turn over point (Detection Point; DP) S14. The presently progressive minimum temperature Min_T is defined as a minimum temperature among temperatures read periodically, and the minimum temperature variation ΔT is defined as a difference of the present period minimum temperature and the initial minimum temperature.

$$DP=(\text{Min_}T*0.5)+(\Delta T*0.5) \quad (1),$$

A greater value ΔTmax of a maximum temperature variation ΔTm and a minimum temperature variation ΔT, and the presently progressive minimum temperature Min_T are applied to the following equation (2), to calculate a heating voltage in the first defrosting S15.

$$\text{First defrosting power}=5*\{20-(0.5*\text{Min_}T)+(0.5*\Delta T\text{max})\} \quad (2),$$

During the defrosting, it is determined that whether the minimum temperature Min_T is higher than a preset temperature 18° C., or the maximum temperature Max_T is higher than 40° C. for two minutes continuously S16. As a result of the determination, if the minimum temperature Min_T is higher than the preset temperature 18° C., or the maximum temperature Max_T is higher than 40° C. for two minutes continuously, the defrosting is ended. However, as a result of the determination, if the minimum temperature Min_T is lower than the preset temperature 18° C., or the maximum temperature Max_T fails to be higher than 40° C.

for two minutes continuously, the turn over time 'DP' is determined of being higher than a preset value 7.5 S17. As a result of the determination S17, if the turn over time 'DP' is higher than the preset value 7.5 though the maximum temperature Max_T fails to be higher than 40° C. for two minutes continuously, a signal sound is issued for informing a turn over time to the user S18. Then, the user opens a door on the microwave oven, turns over the frozen food, and closes the door S19. Re-pressing of the start key by the user is determined S20. As a result of the determination S20, if the user re-pressed the start key, a time period T1 required before the door is opened applied to the following equation (3), to calculate a defrosting finish time point S21.

$$\text{Defrosting finish time point (Final End Power: } EPF) = 51 - 0.14 * T1 \quad (3),$$

(T1: a time period required before the door is opened).

The time period T1 required before the door is opened is applied to the following equation (4), to calculate a constant K, which is applied to the following equation (5), to calculate a second defrosting time period S22.

$$K = (1.4 * T1 + 185)/100 \quad (4),$$

$$\text{A second defrosting time period} = T1 * KT1 \quad (5),$$

Thus, upon calculation of the defrosting finish time point and the second defrosting time period, the presently progressive minimum temperature Min_T, and a minimum value ΔTmin of the minimum temperature variation ΔT and a maximum temperature variation ΔTm are applied to the following equation (6), to calculate a voltage according to which the second defrosting is controlled S23.

$$\text{Second defrosting voltage} = 5 * \{15 * (0.5 * \text{Min_}T) + (0.5 * \Delta T\text{min})\} \quad (6),$$

During the second defrosting, it is determined that the minimum temperature Min_T is higher than the preset temperature 18° C., or the maximum temperature Max_T is higher than 40° C. for two seconds continuously S24. As a result of the determination S24, if the minimum temperature Min_T is higher than the preset temperature 18° C., or the maximum temperature Max_T is higher than 40° C. for two seconds continuously S24, the second defrosting is finished. On the other hand, as a result of the determination S24, if the minimum temperature Min_T is higher than the preset temperature 18° C., or the maximum temperature Max_T is lower than 40° C. for two seconds continuously, the defrosting finish time point EPF calculated in the step S21 is determined of being the present time S25. Then, as a result of the determination S25, if the defrosting finish time point EPF calculated at the step S21 is not the present time, pass of the second defrosting time period calculated in the step S22 is determined S26. If the defrosting finish time point EPF calculated at the step S26 is the present time, or the second defrosting time period is passed, the second defrosting is finished.

A method for controlling defrosting in a microwave oven in accordance with a preferred embodiment of the present invention will be explained.

When a first defrosting is started, the defrosting is started at the calculated first defrosting voltage, to defrost frozen food of which surface temperature is below zero. Since the frozen food is below zero at an initial defrosting, a defrosting voltage is applied for a relatively long time period based on the temperature of the frozen food. Upon the surface temperature of the frozen food rises, the voltage applying time period becomes shorter, gradually.

The frozen food is required to be turned over at a time point when it is determined that the first defrosting is finished as the surface temperature of the frozen food rises a certain temperature through the foregoing steps, of which turning over time DP is determined with reference to the minimum temperature Min_T and a minimum temperature variation ΔT.

In the defrosting after the turn over time point DP, i.e., in the second defrosting too, the infrared sensor is used for detecting the surface temperature and the temperature variation of the frozen food, for controlling the second defrosting. That is, since an initial voltage in the second defrosting is fixed based on an actual surface temperature of the frozen food detected by the infrared sensor, the voltage application time period becomes relatively long at an initial stage of the second defrosting. During defrosting the frozen food as the voltage application is kept on, the voltage application time period is made gradually shorter based on the temperature and the temperature variation detected periodically by the infrared sensor. Therefore, the temperature detection of the frozen food by the infrared sensor in the second defrosting is continued periodically until completion of the defrosting. Thus, it can be known that the voltage application after the turn over time point DP is long initially, and becomes shorter gradually, and the on and off of the voltage application is dropping of a power application according to an extent of defrosting of the frozen food by detecting an actual surface temperature of the frozen food by the infrared sensor. The method for controlling defrosting in a microwave oven of the present invention regulates a voltage application condition according to a defrosted level according to the surface temperature of the frozen food detected by the infrared sensor continuously even in the second defrosting after turn over of the frozen food.

As has been explained, the method for controlling defrosting in a microwave oven of the present invention has the following advantages.

First, the voltage application condition control according to the periodic detection of a surface temperature of frozen food by an infrared sensor, not only in the first defrosting when one side of the frozen food is heated, but also in the second defrosting after the turn over of the frozen food permits an optimal defrosting of the frozen food. That is, the defrosting control based on the surface temperature and the temperature variation of the frozen food permits to prevent a pre-mature, or excessive defrosting.

Second, the optimal defrosting made available by the present invention provides a satisfaction and reliability on the product to the user.

It will be apparent to those skilled in the art that various modifications and variations can be made in the method for controlling defrosting in a microwave oven of the present invention without departing from the spirit or scope of the invention. Thus, it is intended that the present invention cover the modifications and variations of this invention provided they come within the scope of the appended claims and their equivalents.

What is claimed is:

1. A method of defrosting an item in a microwave oven, comprising:

placing the item in the microwave oven;

automatically determining an estimated first defrosting period length based on at least a first item parameter and a second item parameter;

heating the item during a first defrosting period;

turning the item over;

automatically determining an estimated second defrosting period length based on an actual length of the first defrosting period; and heating the item during a second defrosting period length.

2. The method of claim 1, further comprising a step of atomatically determining a microwave power to apply during the first defrosting period based on the first item parameter, and wherein the item is heated at the determined microwave power during the first defrosting period.

3. The method of claim 2, further comprising making multiple measurements of the temperature of the item during the first defrosting period and making corresponding adjustments to the microwave power applied to the item in accordance thereto.

4. The method of claim 1, further comprising a step of automatically determining a microwave power to apply during the second defrosting period based on a third item parameter, wherein the item is heated at the determined power during the second defrosting period.

5. The method of claim 1, wherein the first parameter comprises a minimum temperature of the item from among a plurality of temperature readings, and the second parameter comprises a change of temperature of the item.

6. The method of claim 1, further comprising ending the first defrosting period before the estimated first defrosting period elapses if a detected minimum temperature of the item rises above a first predetermined value.

7. The method of claim 6, further comprising ending the first defrosting period before the estimated first defrosting period elapses if a detected maximum temperature of the item rises above a second predetermined value.

8. The method of claim 1, further comprising ending the second defrosting period before the estimated second defrosting period elapses if a minimum detected temperature of the item exceeds a first predetermined value.

9. The method of claim 8, further comprising ending the second defrosting period before the estimated second defrosting period elapses if a maximum detected temperature of the item exceeds a second predetermined value.

10. A method of defrosting an item in a microwave oven, comprising:

placing the item in the microwave oven;

automatically determining a first microwave power to apply during a first defrosting period based on a first item parameter and a second item parameter;

heating the item during a first defrosting period in accordance with the determined first microwave power;

turning the item over after the end of the first defrosting period;

automatically determining a second microwave power to apply during a second defrosting period based on the first item parameter and a third item parameter; and heating the item during a second defrosting period in accordance with the second determined microwave power.

11. The method of claim 10, wherein the first item parameter comprises a temperature of the item, and the second item parameter comprises a change of temperature of the item.

12. The method of claim 11, wherein the first item parameter comprises a minimum temperature of the item that is selected from a plurality of detected temperatures taken during a temperature measurement period.

13. The method of claim 12, wherein the second item parameter comprises a maximum change of temperature of the item.

14. The method of claim 10, wherein the third item parameter comprises a minimum change of temperature of the item.

15. The method of claim 10, further comprising:

making multiple measurements of a temperature of the item during the first defrosting period; and making corresponding adjustments to the first microwave power in accordance therewith.

16. The method of claim 15, further comprising:

making multiple measurements of a temperature of the item during the second defrosting period; and making corresponding adjustments to the second microwave power in accordance therewith.

17. The method of claim 10, further comprising:

automatically determining an estimated first defrosting period length based on the first item parameter; and automatically determining an estimated second defrosting period length based on an actual length of the first defrosting period.

18. The method of claim 17, further comprising ending the first defrosting period before the estimated first defrosting period length elapses if a minimum temperature of the item exceeds a first predetermined temperature, or if a maximum temperature of the item exceeds a second predetermined temperature.

19. The method of claim 17, further comprising ending the second defrosting period before the estimated second defrosting period length elapses if a minimum temperature of the item exceeds a first predetermined temperature, or if a maximum temperature of the item exceeds a second predetermined temperature.

20. A method of defrosting an item in a microwave oven, comprising:

placing the item in the microwave oven;

measuring a temperature of the item at multiple different times;

measuring a change in the temperature of the item;

automatically determining an estimated defrosting period length based on a minimum measured temperature of the item and the measured change in the temperature of the item;

automatically determining a microwave power to apply to the item based on the minimum measured temperature; and heating the item in accordance with the estimated defrosting period length and the determined microwave power.

21. The method of defrosting an item of claim 20, further comprising:

making multiple measurements of the temperature of the item during the defrosting period; and making corresponding adjustments to the microwave power in accordance therewith.

22. The method of defrosting of claim 21, further comprising ending the first defrosting period before the estimated defrosting period elapses if the temperature of the item rises above a predetermined value.

23. The method of claim 20, further comprising:

determining a minimum temperature change of the item, which represents the difference between two minimum temperatures of the item detected during two different time periods; and determining a maximum temperature change of the item, which represents a difference between two maximum temperatures of the item detected during two different time periods, and wherein the microwave power is also determined based on the larger of the determined minimum temperature change and the determined maximum temperature change.

24. The method of claim 20, wherein the heating step comprises a first defrosting step, and further comprising:

turning the item over after the first defrosting step has been completed;

automatically determining an estimated second defrosting period length based on an actual length of the first defrosting step; and heating the item in accordance with the estimated second defrosting period length to accomplish a second defrosting step.

25. The method of claim 24, further comprising determining a microwave power to apply to the item during the second defrosting step based on a minimum measured temperature of the item.

26. The method of claim 25, further comprising:

determining a minimum temperature change of the item, which represents the difference between two minimum temperatures of the item detected during two different time periods; and determining a maximum temperature change of the item, which represents a difference between two maximum temperatures of the item detected during two different time periods, and wherein the microwave power for the second defrosting step is also determined based on the smaller of the determined minimum temperature change and the determined maximum temperature change.

* * * * *